US010145095B1

(12) United States Patent
Schuster et al.

(10) Patent No.: US 10,145,095 B1
(45) Date of Patent: Dec. 4, 2018

(54) TOILET BOWL OVERFLOW PREVENTION

(75) Inventors: Michael J. Schuster, Shorewood, IL (US); Duston E. A. Stutzman, Plainfield, IL (US); Douglas C. Saunders, Plainfield, IL (US)

(73) Assignee: DANCO, INC., Irving, TX (US)

( * ) Notice: Subject to any disclaimer, the term of this patent is extended or adjusted under 35 U.S.C. 154(b) by 1005 days.

(21) Appl. No.: 13/561,009

(22) Filed: Jul. 28, 2012

Related U.S. Application Data

(60) Provisional application No. 61/513,399, filed on Jul. 29, 2011.

(51) Int. Cl.
*E03D 11/00* (2006.01)

(52) U.S. Cl.
CPC ..... *E03D 11/00* (2013.01)

(58) Field of Classification Search
USPC ..... 4/324, 427, 362, 405–414
See application file for complete search history.

(56) References Cited

U.S. PATENT DOCUMENTS 2,809,378 A * 10/1957 Newton, Jr. ..... 4/324
3,358,294 A * 12/1967 Nolan et al. ..... 4/661
3,745,591 A * 7/1973 Girten ..... E03D 1/142 4/324
4,956,880 A * 9/1990 Bailet ..... E03D 1/142 4/378
5,553,333 A * 9/1996 Andersson ..... 4/354
7,155,752 B2 * 1/2007 Feda ..... 4/427
2011/0041242 A1 * 2/2011 Courtney et al. ..... 4/324
2011/0107509 A1 * 5/2011 Charpentier ..... E04H 4/086 4/498
2012/0266374 A1 * 10/2012 Liu ..... E03D 1/34 4/324

FOREIGN PATENT DOCUMENTS

EP 0997585 A1 * 5/2000 ..... E03D 5/094

* cited by examiner

*Primary Examiner* — Lauren Crane
(74) *Attorney, Agent, or Firm* — Thomas Horstemeyer, LLP

(57) ABSTRACT

The present disclosure is directed towards preventing an overflow of a toilet bowl in the event of, for example, a clogged toilet. A toilet flush handle may be in communication with a toilet flush valve. The toilet flush handle may be configured to rotate in a first direction and in a second direction. By rotating in the first direction, the toilet flush handle may initiate a toilet flush. By rotating in the second direction, the toilet flush handle may interrupt the toilet flush.

20 Claims, 13 Drawing Sheets

TOILET BOWL OVERFLOW PREVENTION

CROSS-REFERENCE TO RELATED APPLICATIONS

This application claims priority to U.S. provisional application entitled "TOILET FLUSH VALVE WITH BOWL OVERFLOW PREVENTION," having application No. 61/513,339, filed Jul. 29, 2011, which is incorporated by reference herein in its entirety.

BACKGROUND

A typical toilet used in domestic applications may include a toilet bowl mounted on a floor surface. The toilet bowl may be in communication with a drain that takes away the contents of the toilet bowl. The toilet may also include a water supply tank at a higher elevation that provides the proper amount of water during a flush cycle of the toilet bowl. In order to refill the tank after a flush cycle, a float in the toilet tank lowers, thereby opening a fill valve that supplies replacement water to the tank. The float may respond to the rising level of the liquid in the tank by closing the fill valve. If the drain opening of the toilet is clogged and the toilet is flushed, the fresh replacement water coming from the toilet tank to the bowl may cause the water level in the toilet bowl to rise. This may create a hazard of an overflow of the contents in the toilet bowl.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Various structures described herein may be compatible with single-flush, dual-flush, or other types of toilet flushing systems. A single-flush toilet system may be a toilet system that uses a single substantially-consistent quantity of water for all of its flushes. On the other hand, a dual-flush toilet system may have multiple quantities of water that may be selectable for use when flushing. For instance, with a dual-flush toilet system, a user may select a first amount of water (e.g., a "partial flush") for liquid waste and a second amount of water (e.g. a "full flush") for solid waste.

Figure 1B:
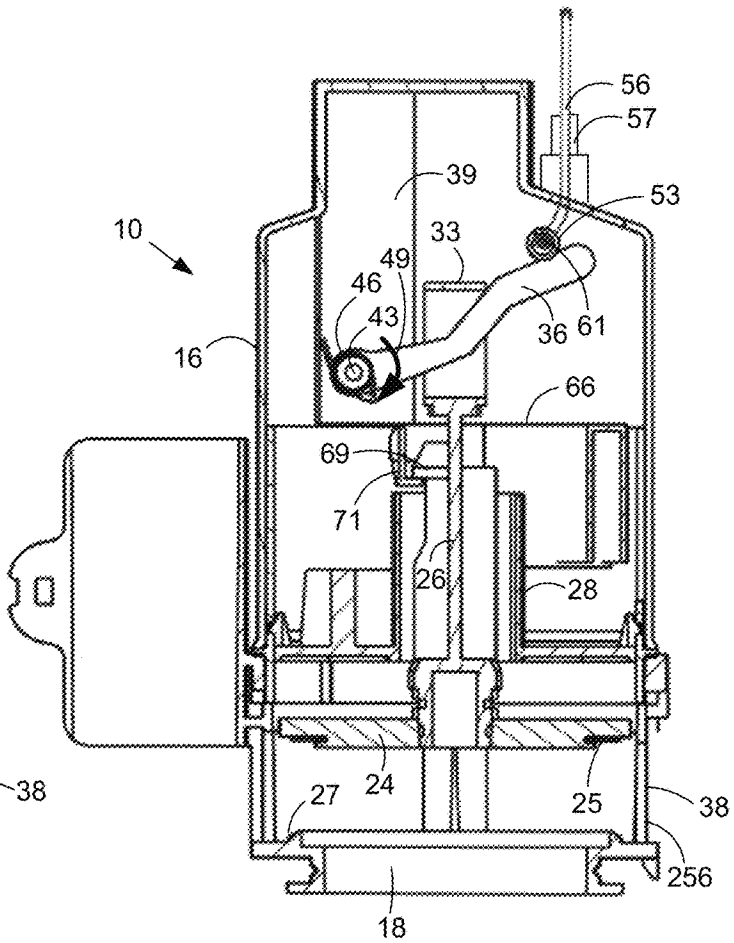
FIGS. 1A-1D are drawings of an example of a toilet tank flush valve assembly according to various embodiments of the present disclosure.
Figure 1A:
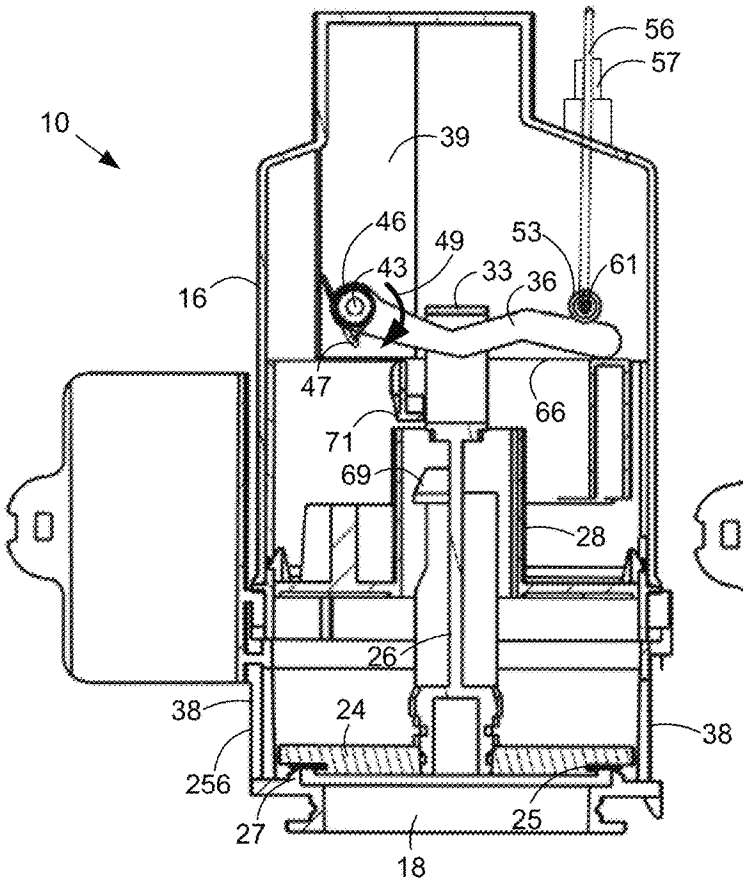
Figure 1D:
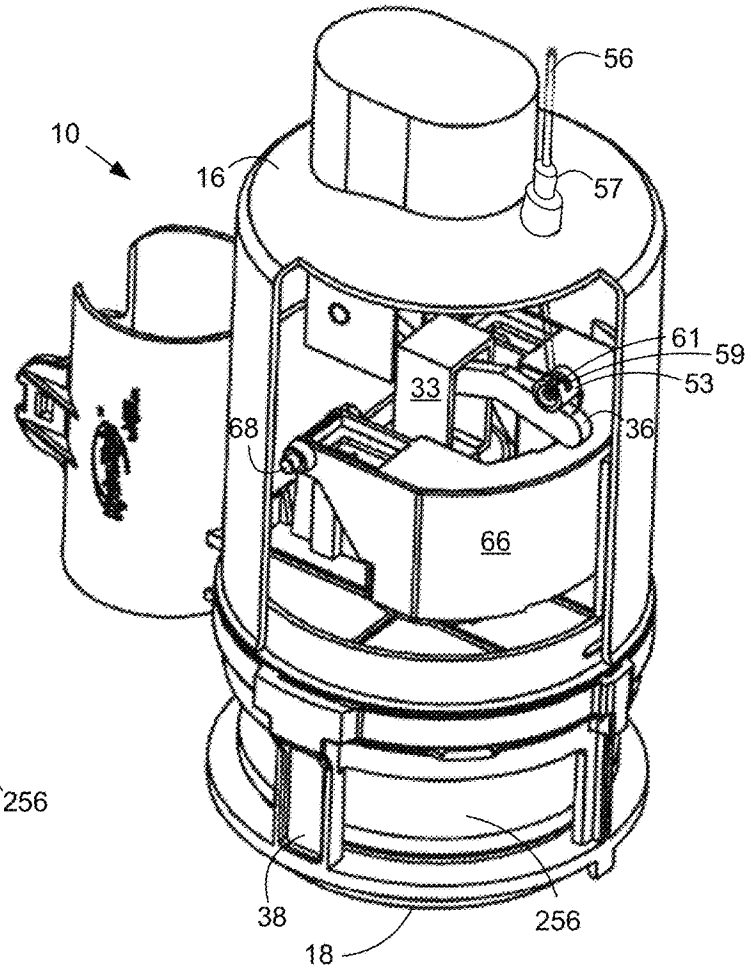
Figure 1C:
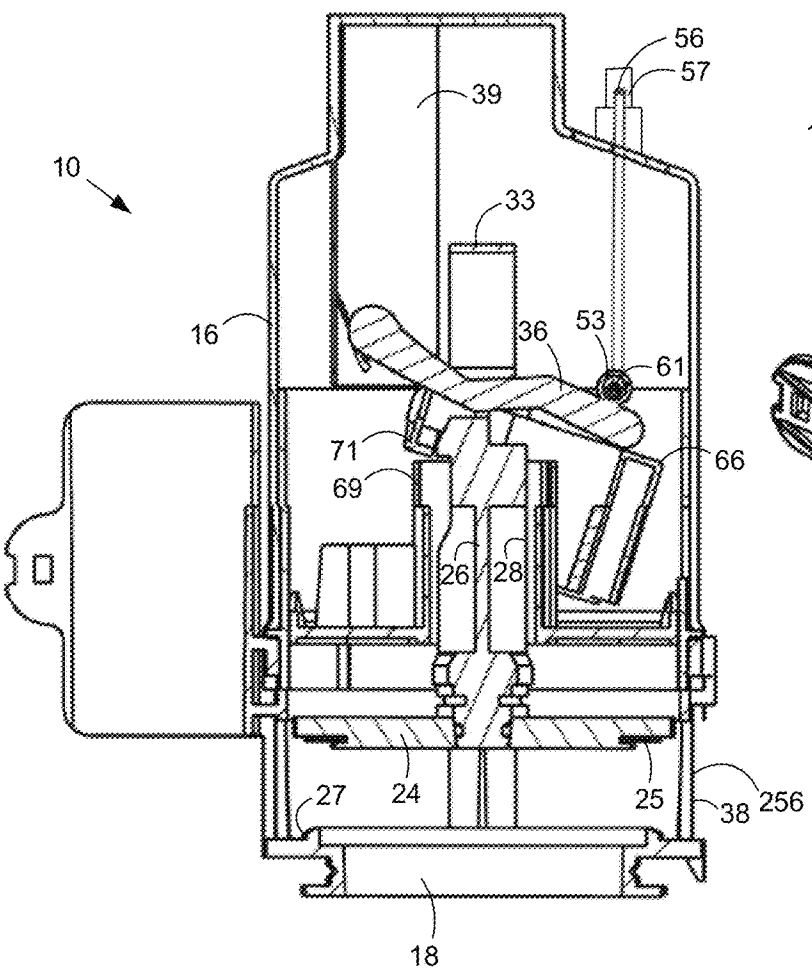

Referring to FIGS. 1A-1D, shown is an example of a single-flush toilet flush valve assembly 10 according to various embodiments of the present disclosure. In particular, FIG. 1A shows the toilet flush valve assembly 10 in a neutral position, FIG. 1B, shows the toilet flush valve assembly 10 in a position that may facilitate water exiting the toilet tank into the toilet bowl, and FIG. 1C shows the toilet flush valve assembly 10 in a position that may interrupt a water flow and thereby stop the water from exiting the toilet tank and into the toilet bowl. FIG. 1D shows a perspective cross-section view of the toilet flush valve assembly 10 in a neutral position.

The toilet flush valve assembly 10 may be mounted in a toilet tank (not shown) that may be in registration with an inlet opening of a toilet bowl (not shown). The toilet flush valve assembly 10 may include a housing 16 that further includes an outlet opening 18 at its bottom. The outlet opening 18 may register with an opening (not shown) of the toilet bowl. Further, the toilet flush valve assembly 10 may include legs 38 that define water ports. The water ports may facilitate water flowing from the toilet tank, through the lower portion of the external housing 16, through the outlet opening 18 of the toilet flush valve assembly 10, and down through the inlet opening of a toilet bowl.

The flush valve assembly 10 may further include a valve plate 24 that registers with and seals the outlet opening 18 of the toilet flush valve assembly 10. Also, an upright valve stem 26 may be connected at a lower portion to the valve plate 24. A sealing gasket 25 may be disposed on the valve plate 24 and engage a seal ring 27 that defines an opening of the flush valve assembly 10. Also, the valve stem 26 may extend upwardly through a tubular passage 28 to a rectangular (or other appropriately shaped) collar 33 that is attached to or formed as part of the upper end of the valve stem 26.

A lever 36 may be pivotally mounted on a support plate 39 by a pivot 43. The pivot 43 may be, for example, a pin extending through the support plate 39 and through the lever 36. In some embodiments, the pivot 43 may be one or more pins, tabs, or other appropriate mechanisms that extend from the lever 36 and interface with the inner wall of housing 16 to facilitate pivoting of the lever 36. In other embodiments, the pivot 43 may be one or more pins, tabs, or other appropriate mechanism that may extend from the inner wall of the housing 16 and facilitate pivoting of the lever 36. Also, a spring 46 may be disposed around the pivot 43 with one end of the spring 46 against a portion off the support plate 39. In an alternative embodiment, the spring 46 may be against, for example, tabs or other extensions extending from the inner wall of housing 16. In the embodiment shown, the other end of spring 46 may be against a downwardly facing foot 47 or other appropriate mechanism that is, for example, attached to the lever 36. The spring 46 may provide a force biasing the lever 36 in a direction indicated generally by the arrow 49.

The end of the lever 36 opposite of the pivot 43 may be attached to a cable connector 53, for example, comprising a tubular structure. A flush actuator cable 56 may extend from an toilet flush handle assembly (not shown) that is mounted on the toilet tank in which the toilet flush valve assembly 10 is mounted. In some embodiments, the actuator cable 56 may be rigid. A cable sleeve 57 may be attached to the housing 16 and may encase the actuator cable 56 external to the housing 16. Additionally, the actuator cable 56 may extend downwardly through the upper portion of the external housing 16, with the lower terminal end of the actuator cable 56 passing through a slot 59 of the cable connector 53 as shown in FIG. 1D. An enlarged terminal end 61 of the actuator cable 56 may project below the slot 59, thereby facilitating a connection between the actuator cable 56 and the lever 36.

Next, a general description of the flush valve assembly 10 initiating a toilet flush is provided. To begin, it is assumed that the flush valve assembly 10 is installed and prepared to initiate a toilet flush. Upward movement of the flush actuator cable 56 causes the enlarged terminal end 61 to lift the cable connector 53. This upward movement may be provided, for example, by the toilet flush handle assembly (not shown). The upward movement of the actuator cable 56 causes the lever 36 to rotate in a direction that is opposite to the force of the spring 46, which is indicated generally by the arrow 49. The lever 36 may engage and lift the top portion of collar 33, thereby lifting the valve stem 26 and causing the valve plate 24 to rise. Accordingly, this may unseal the flush valve assembly 10 to the position as shown in FIG. 1B.

When the valve plate 24 is lifted as described above, the valve plate 24 may pass water ports 256 defined by the legs 38. As such, water may flow from the toilet tank through the outlet opening 18 of the toilet flush valve assembly 10, and through a gasket 233 (FIG. 4B). The gasket 233 may mate with a flush orifice (not shown) that leads into the toilet bowl.

As best shown in FIG. 1D, a tiltable float 66 may be supported by a pivot 68 at, for example, the mid-level of the external housing 16. The pivot 68 may be, for example, one or more pins, tabs, or other appropriate mechanisms that facilitate tilting of the float 66. The float 66 may float on the surface of the water and may thus tilt in response to vertical movement of the surface of the water.

The valve stem 26 may include a lateral projection 69 that passes up through the tiltable float 66 when it is lifted by the flush actuator cable 56. The float 66 may also include a laterally extending hook 71 that faces the path of movement of the valve stem 26. As shown in FIG. 1B, when the valve stem 26 is raised high enough for its lateral projection 69 to pass above the lateral extending hook 71 of the float 66, the lateral extending hook 71 of the float 66 may restrict downward movement of the valve stem 26. This arrangement may hold the valve stem 26 and valve plate 24 elevated so that the valve plate 24 does not descend to seal the outlet opening 18. As such, water may drain from the toilet tank through the water ports 256 defined by legs 38 in the external housing 16 and into the toilet bowl.

The float 66 may be supported by the pivot 68, so that when the water level descends, the float 66 progressively tilts. When the water level drops below a particular level, the float 66 tilts sufficiently for the laterally extending hook 71 to slip out from beneath the lateral projection 69 of the valve stem 26. By the hook 71 slipping out from beneath the lateral projection 69, the valve stem 26 and the valve plate 24 are released to move downwardly into a closed relationship with respect to the outlet opening 18 of the external housing 16, thus terminating the flow of water to the toilet bowl. Thus, the toilet flush may be completed.

It some cases, it may be desirable to prematurely stop water from flowing from the toilet tank into the toilet bowl. For instance, an operator of the toilet may desire to stop the water in the event of a hazard of an overflow condition in the toilet bowl. The following discussion provides an example of an emergency termination of water flow into the toilet bowl.

In the event of, for example, a hazard of an overflow condition in the toilet bowl below, the operator of the toilet can move the actuator handle (not shown) that is connected to the flush actuator cable 56 to lower the flush actuator cable 56 and thereby rotate the lever 36 from the position shown in FIGS. 1A and 1B to the position shown in FIG. 1C. This causes the lever 36 to engage the upper surface or any other appropriate portion of the float 66, thereby tilting the float 66. In response, the outwardly extending hook 71 of the float 66 moves from beneath the lateral projection 69 of the valve stem 26. This removes the support from the valve stem 26 and the valve plate 24 so that, under the influence of gravity and the downward movement of the water through the valve outlet opening 18, the valve stem 26 and valve plate 24 move downward until the gasket 25 of the valve plate 24 is seated on the seal ring 27. As such, the outlet opening 18 of the housing 16 may be closed. This maneuver may completely and abruptly terminate the flow of water from the toilet tank to the toilet bowl, thereby averting an overflow condition of the toilet bowl.

Figure 2B:
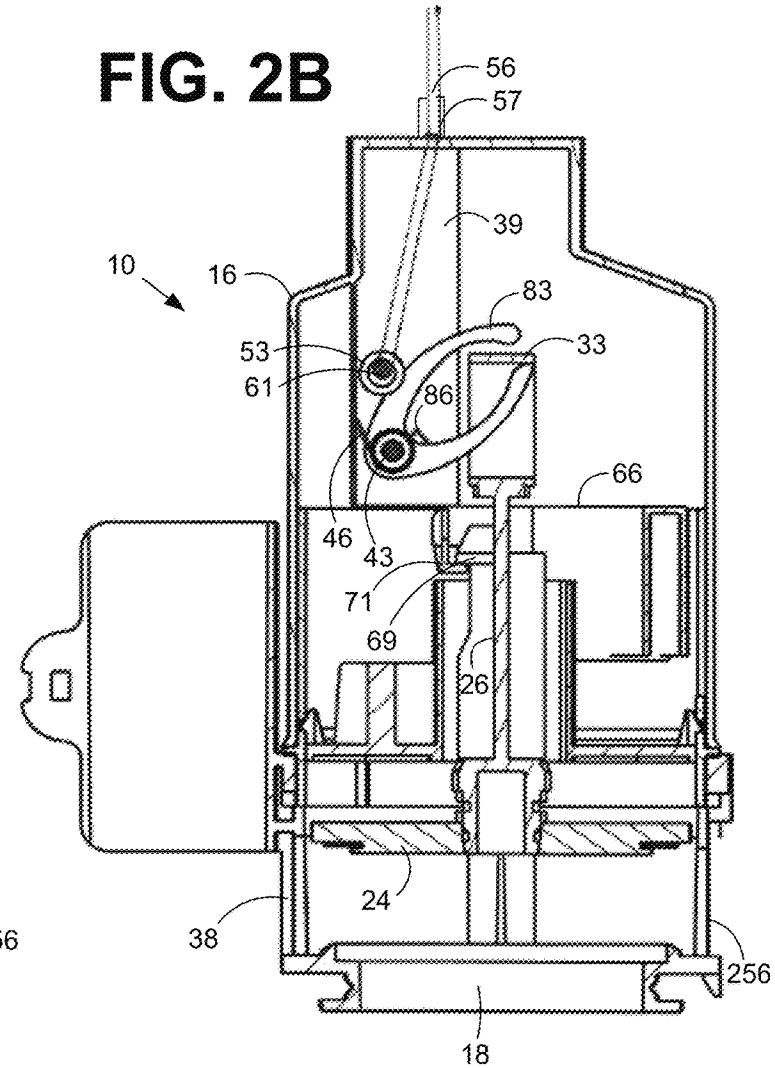
FIGS. 2A-2D are drawings of another example of a toilet tank flush valve assembly according to various embodiments of the present disclosure.
Figure 2A:
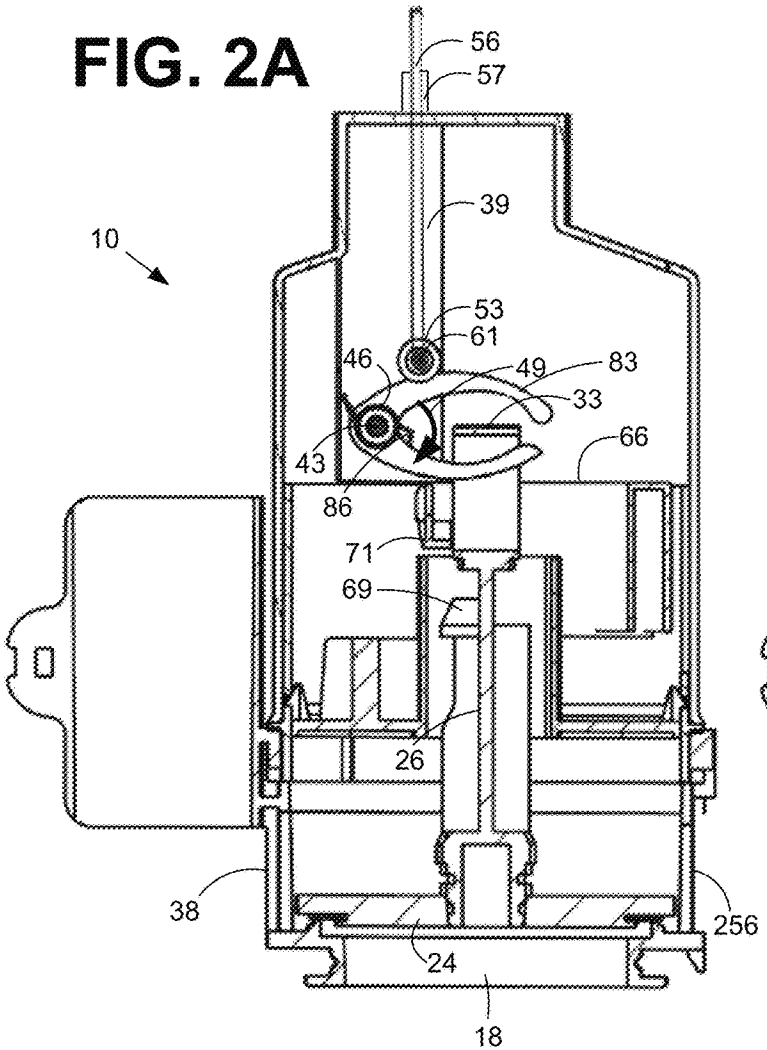
Figure 2D:
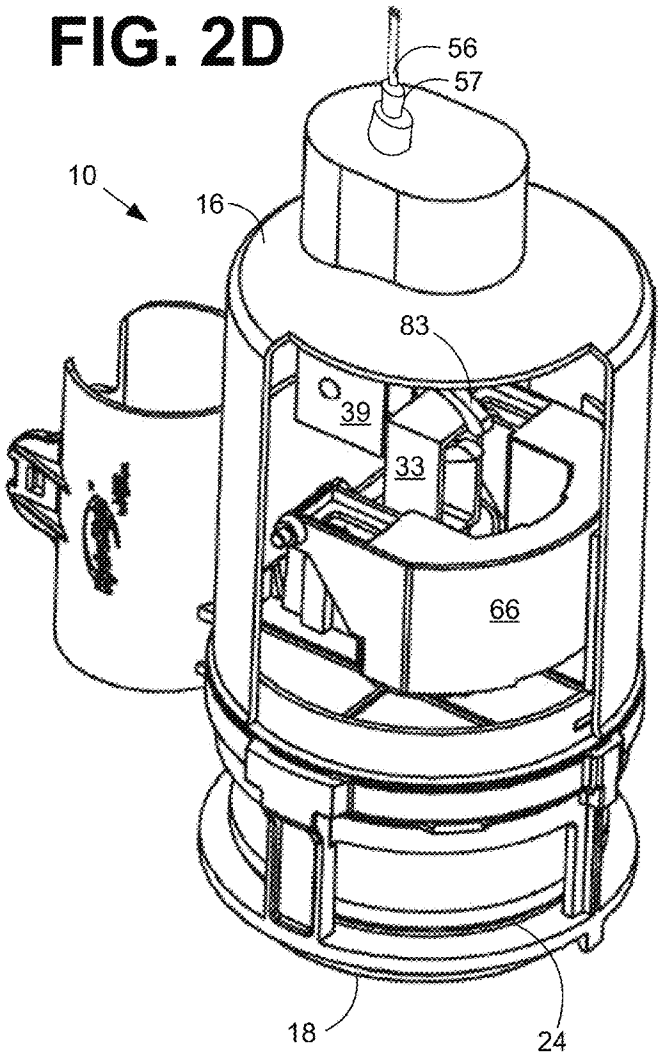
Figure 2C:
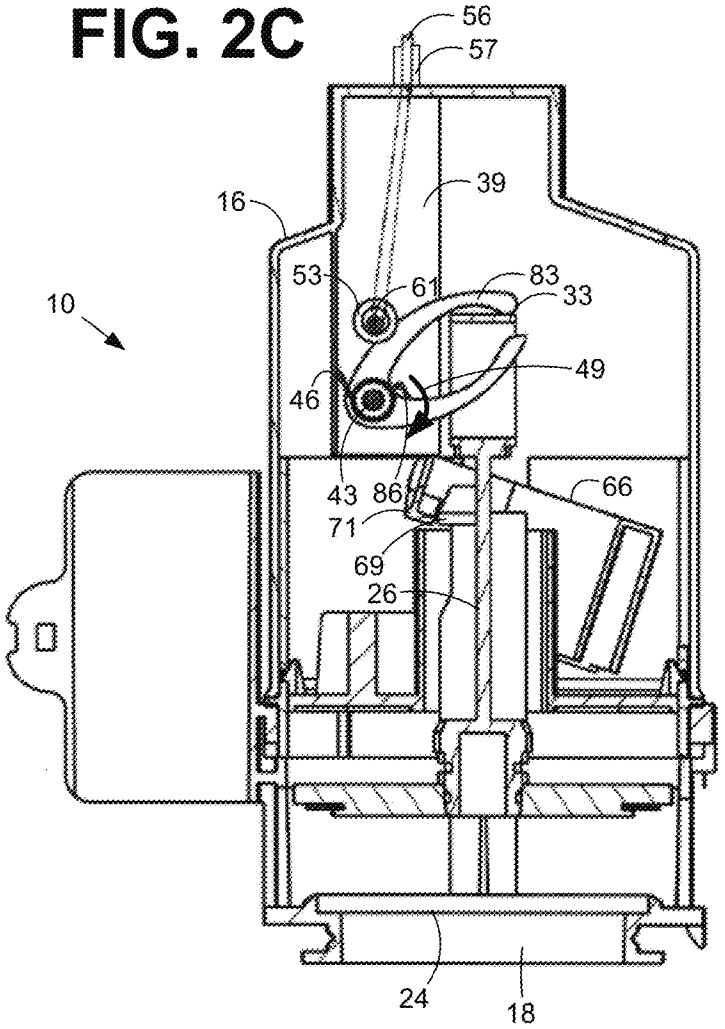

Turning now to FIGS. 2A-2D, shown is another example of a flush valve assembly 10 according to various embodiments of the present disclosure. In particular, FIG. 2A shows the toilet flush valve assembly 10 in a neutral position, FIG. 2B, shows the toilet flush valve assembly 10 in a position that may facilitate water exiting the toilet tank into the toilet bowl, and FIG. 2C shows the toilet flush valve assembly 10 in a position that may interrupt a toilet flush. FIG. 2D shows a perspective cross-section view of the toilet flush valve assembly 10 in a neutral position.

The valve plate 24, valve stem 26, and float 66 in the embodiment shown in FIGS. 2A-2D may be similar to as those previously described with respect to FIGS. 1A-1D. In the present example, however, a wishbone-shaped actuator 83 may be pivotally mounted on the support plate 39 by the pivot 43. The pivot 43 may be, for example, a pin extending through the support plate 39 and through the wishbone-shaped actuator 83. In some alternative embodiments, the pivot 43 may be, for example, one or more pins, tabs, or other appropriate mechanisms that extend from the wishbone-shaped actuator 83 and interface with the inner wall of housing 16 to facilitate pivoting of the wishbone-shaped actuator 83. In further embodiments, the pivot 43 may be one or more pins, tabs, or other appropriate mechanisms that extend from the inner wall of the housing 16 and facilitate pivoting of the wishbone-shaped actuator 83.

Also, a spring 46 may be disposed around the pivot 43 with one end of the spring 46 against support plate 39. The other end of spring 46 may be against an upwardly facing foot 86 or other appropriate location of the wishbone-shaped actuator 83. The spring 46 may provide a biasing force against the wishbone-shaped actuator 83 in a direction indicated generally by arrow 49. The bottom portion of the wishbone-shaped actuator 83 may pass through the collar 33, while the top portion of the wishbone-shaped actuator 83 may be attached to the cable connector 53, which may comprise a tubular structure.

As shown in FIG. 2B, upward movement of the flush actuator cable 56 may cause the enlarged terminal end 61 of the actuator cable 56 to lift the cable connector 53. In response, the wishbone-shaped actuator 83 may rotate in a direction that is opposite to the biasing force provided by the spring 46, as indicated generally by the arrow 49. The bottom portion of the wishbone-shaped actuator 83 may engage and lift the top portion of collar 33. In turn, the valve stem 26 may lift, thereby causing the valve plate 24 to rise. This may open the flush valve assembly 10 to the position shown in FIG. 2B.

With reference to FIG. 2C, the following discussion provides an example of an interruption of water flow into the toilet bowl using the flush valve assembly 10 according to various embodiments. In the event of, for example, an emergency hazard of an overflow condition in the toilet bowl (not shown) below, the user of the toilet can move the toilet flush handle (not shown) that is in communication with the actuator cable 56 to lower the actuator cable 56. In response, the wishbone-shaped actuator 83 may rotate to the position shown in FIG. 2C. This may cause the top portion of the wishbone-shaped actuator 83 to engage and push down the top portion of the collar 33.

In turn, downward pressure on the collar 33 moves the lateral projection 69 past the hook 71. As a result, the float 66 may pivot so that its outwardly extending hook 71 moves from beneath the lateral projection 69 of the valve stem 26. This may remove the support from the valve stem 26 and valve plate 24 so that, under the influence of gravity and the downward movement of the water through the valve outlet opening 18, the valve stem 26 and valve plate 24 may move downwardly until the gasket 25 of valve plate 24 is seated on the seal ring 27. Accordingly, the outlet opening 18 of the housing 16 may be sealed and the flow of water into the toilet bowl may be interrupted.

Figure 3B:
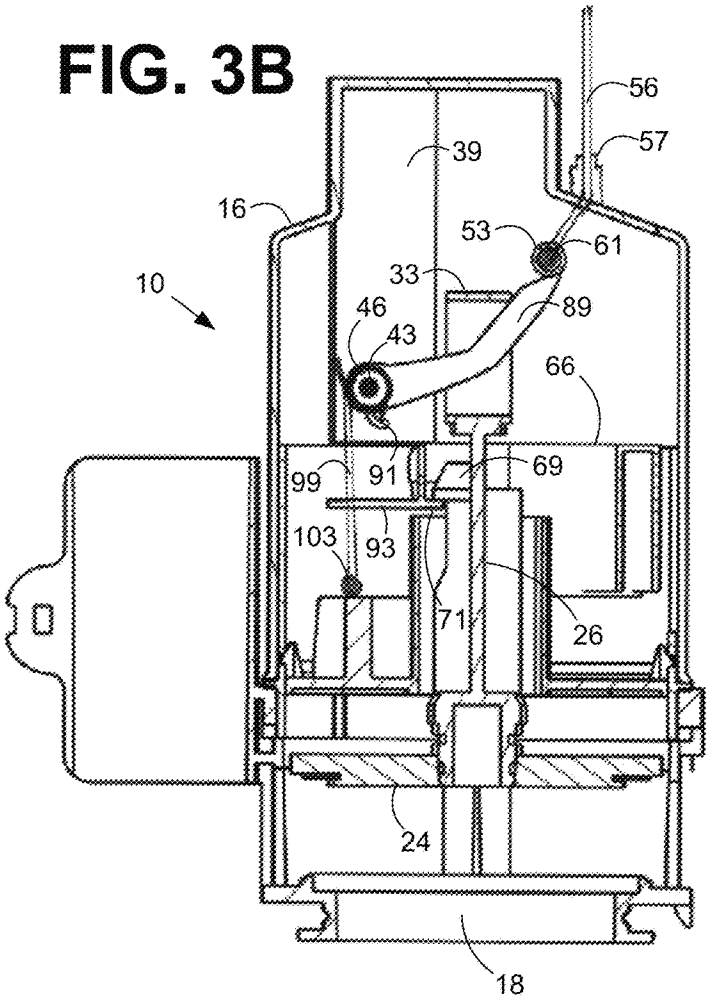
FIGS. 3A-3D are drawings of another example of a toilet tank flush valve assembly according to various embodiments of the present disclosure.
Figure 3A:
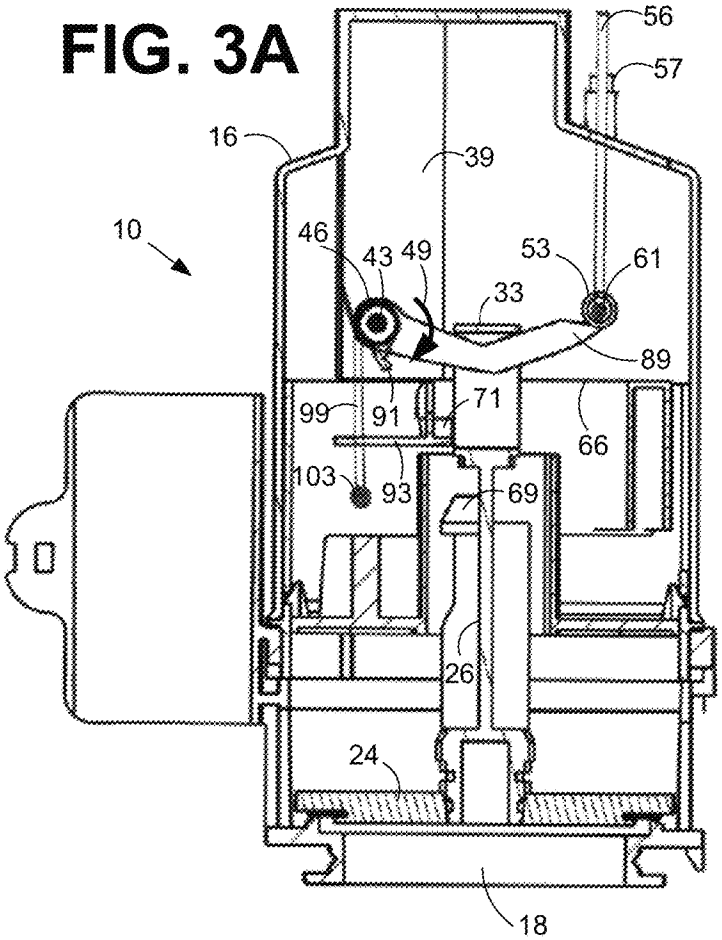
Figure 3D:
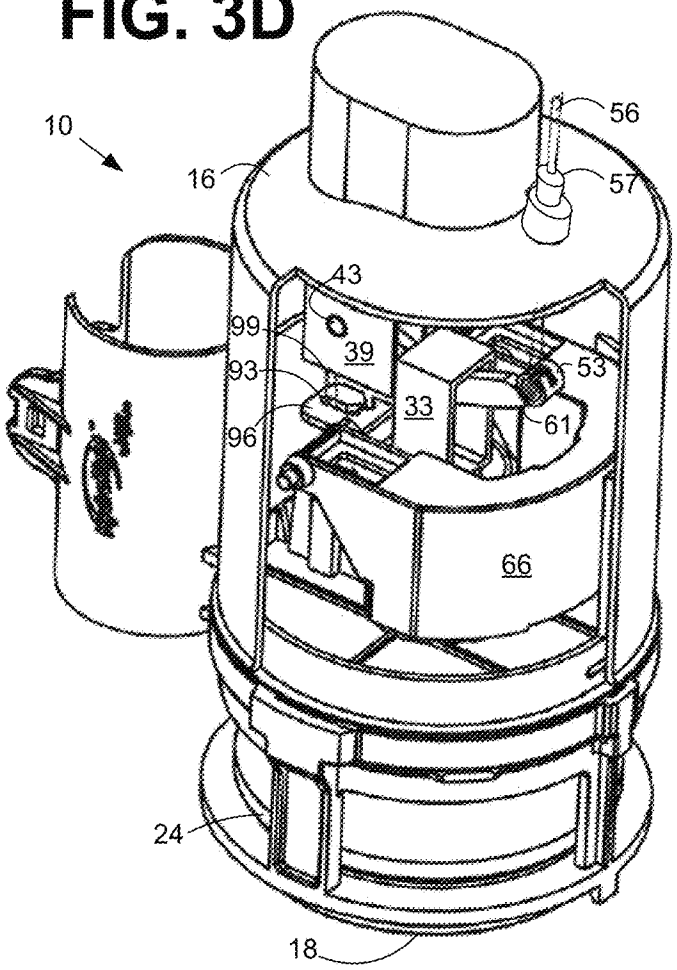
Figure 3C:
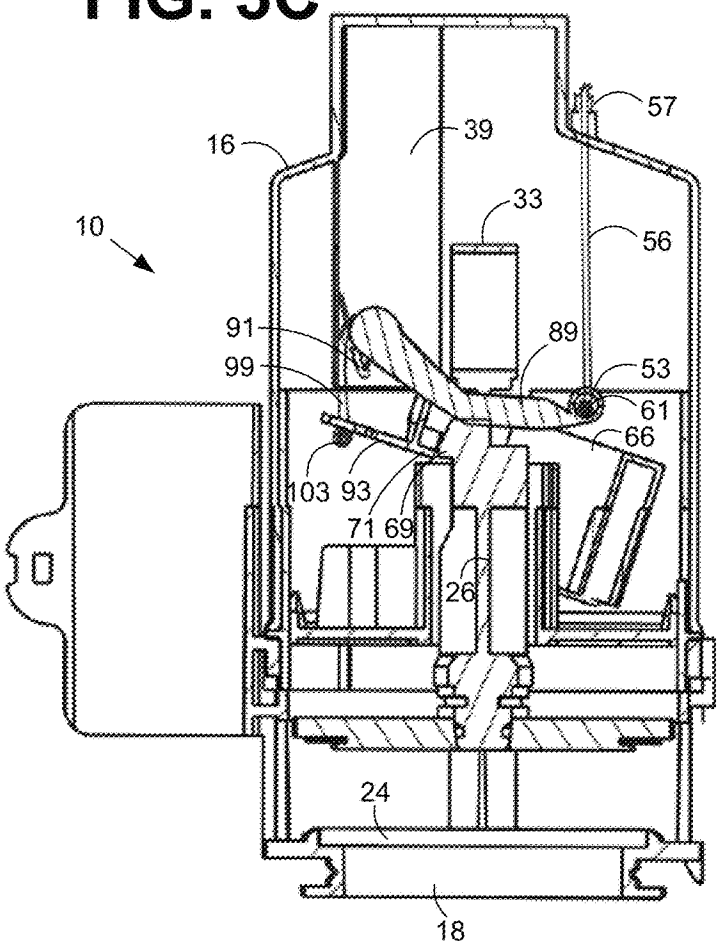

Turning now to FIGS. 3A-3D, shown is another example of a flush valve assembly 10 according to various embodiments of the present disclosure. In particular, FIG. 3A shows the toilet flush valve assembly 10 in a neutral position, FIG. 3B, shows the toilet flush valve assembly 10 in a position that may facilitate water exiting the toilet tank into the toilet bowl, and FIG. 3C shows the toilet flush valve assembly 10 in a position that may interrupt water from exiting the toilet tank into the toilet bowl. FIG. 3D shows a perspective cross-section view of the toilet flush valve assembly 10 in a neutral position.

In the toilet flush assembly 10 shown in FIGS. 3A-3D, the valve plate 24 and valve stem 26 may be similar to those as previously described with respect to FIGS. 1A-1D and/or FIGS. 2A-2D. In the present embodiment, however, a finger 89 may be pivotally mounted on the support plate 39 by the pivot 43. The pivot 43 may be, for example, a pin extending through the support plate 39 and through the finger 89. In some embodiments, the pivot 43 may be one or more pins, tabs, or other appropriate mechanisms that extend from the finger 89 and interface with the inner wall of housing 16 to facilitate pivoting of the finger 89. Alternatively, the pivot 43 may be one or more pins, tabs, or other appropriate means that extend from the inner wall of the housing 16 and facilitate pivoting by the finger 89. The finger 89 may extend through the collar 33 with the end opposite of the pivot 43 extending beyond the collar 33.

Also, the spring 46 may be disposed around the pivot 43 with one end of the spring 46 against the support plate 39. In an alternative embodiment, the spring 46 may be against tabs or other mechanisms that extend from the inner wall of housing 16 and support the finger 89. The other end of the spring 46 may be against a downwardly facing foot 91 or other appropriate mechanism that is attached to the finger 89 so as to provide a force biasing the finger 89 in a downward direction indicated generally by the arrow 49. The finger 89 may further include the connector 53 to facilitate connection to the actuator cable 56 using the enlarged terminal end 61 of the actuator cable 56.

As shown in FIG. 3B, upward movement of the flush actuator cable 56 may cause the enlarged terminal end 61 to lift the cable connector 53. In response, the finger 89 may rotate in a direction that is opposite to the direction of the force provided by the spring 46, which is indicated generally by the arrow 49. In turn, the finger may engage the top portion of the collar 33, which in turn lifts the valve stem 26. Accordingly, the valve plate 24 raises, thereby unsealing the opening 18 in the flush valve assembly 10, as shown in FIG. 3B.

A projection 93 may be rigidly mounted to or formed as part of the float 66. Additionally, the projection may include a slot 96, best shown in FIG. 3D, through which a cable 99 may pass. An enlarged lower terminal end 103 may project below the slot 96, while the upper end of the cable 99 may be attached to the finger 89. The upper end of the cable 99 may be attached to the finger 89, for example, using a connector or by being wrapped around the pivot 43.

In the event of a hazard of an overflow condition in the toilet bowl below, the operator of the toilet can move a toilet flush handle (not shown) that is in communication with the actuator cable 56 to lower the flush actuator cable 56 and thereby rotate the finger 89 to the position shown in FIG. 3C. This maneuver may cause the enlarged lower terminal end 103 of the cable 99 to engage and raise the projection 93. In turn, the float 66 may tilt so that the float's outwardly extending hook 71 displaces from beneath the lateral projection 69 of the valve stem 26. This may immediately remove the support from the valve stem 26 and valve plate 24 so that, under the influence of gravity and the downward movement of the water through the valve outlet opening 18, the valve stem 26 and the valve plate 24 may move downwardly until the gasket 25 of valve plate 24 is seated on the seal ring 27. As such, the outlet opening 18 of the housing 16 may be sealed.

Figure 4A:
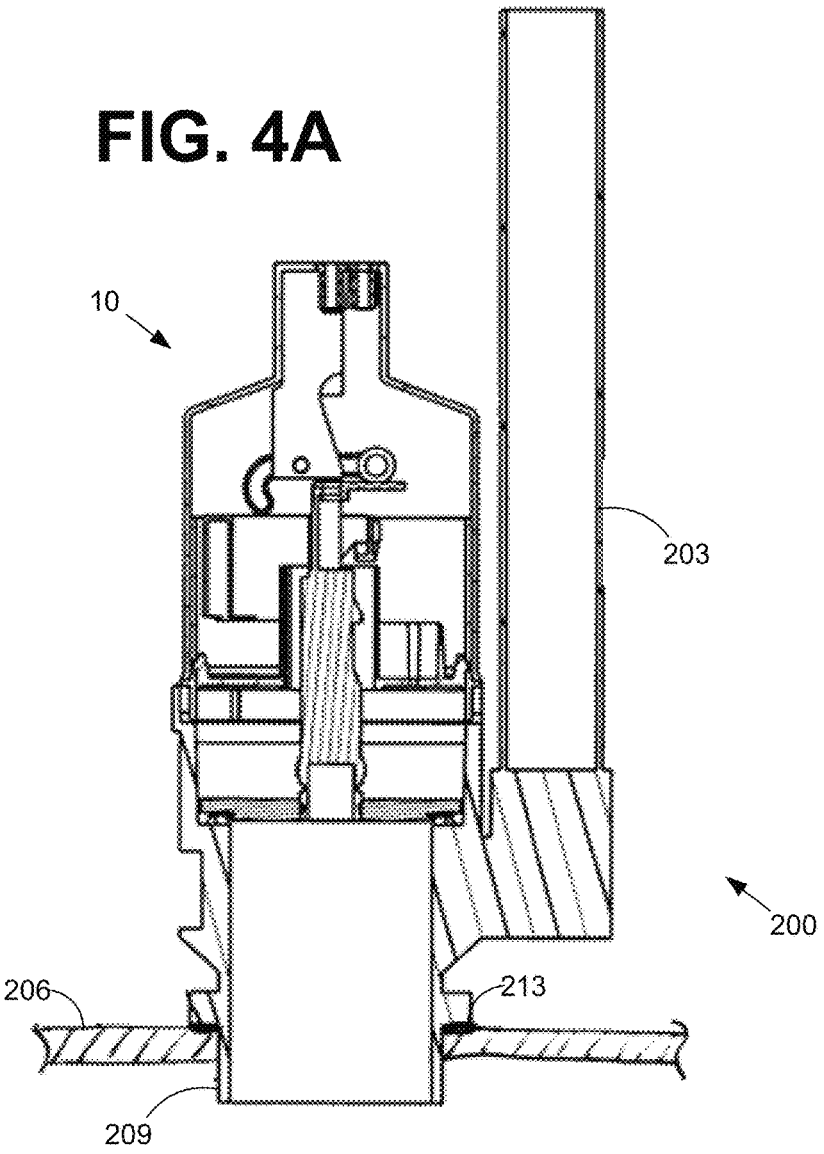
FIG. 4A is a drawing showing an example of a toilet tank flush valve of FIGS. 1A-1D, 2A-2D, and 3A-3D installed in a toilet tank according to various embodiments of the present disclosure.
Figure 4B:
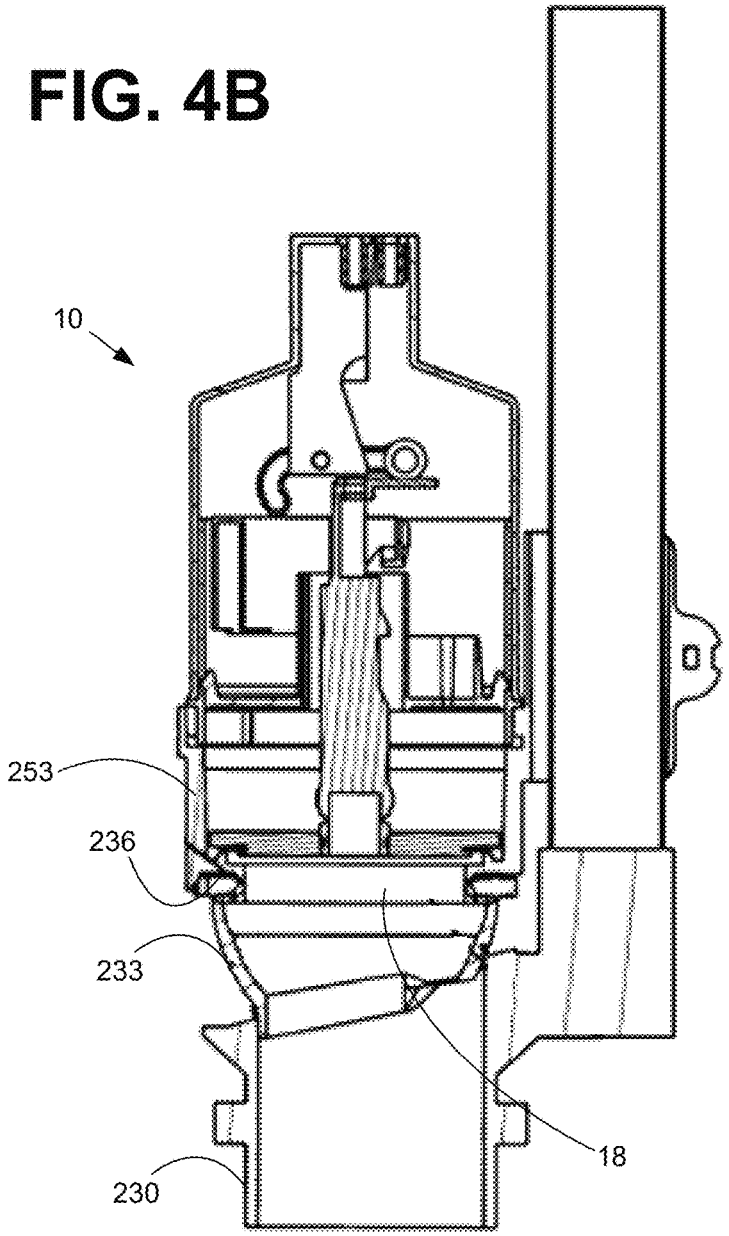
FIGS. 4B-4C are drawings showing an example of a toilet flush valve assembly of FIGS. 1A-1D, 2A-2D, and 3A-3D mounted to a previously-existing flush valve according to various embodiments of the present disclosure.

FIG. 4A shows an example of the toilet flush valve assembly 10 comprising an integrally molded portion of a flush valve 200. In alternative embodiments, the toilet flush valve assembly 10 may be rigidly connected to the remaining portion of the flush valve 200 via a screw fit connection, a pressure fitted connection, or some other connection that provides for proper sealing to prevent leakage of water. The flush valve 200 may include a standpipe 203 and be mounted to a floor 206 of a toilet tank (not shown). In some embodiments, the flush valve 200 may include a thread 209 that engages a nut (not shown) to fasten the flush valve 200 to the floor 206 of the toilet tank. A gasket 213 may be positioned to form a seal between the flush valve 200 and the floor 206 of the toilet tank to prevent leakage.

Figure 4C:
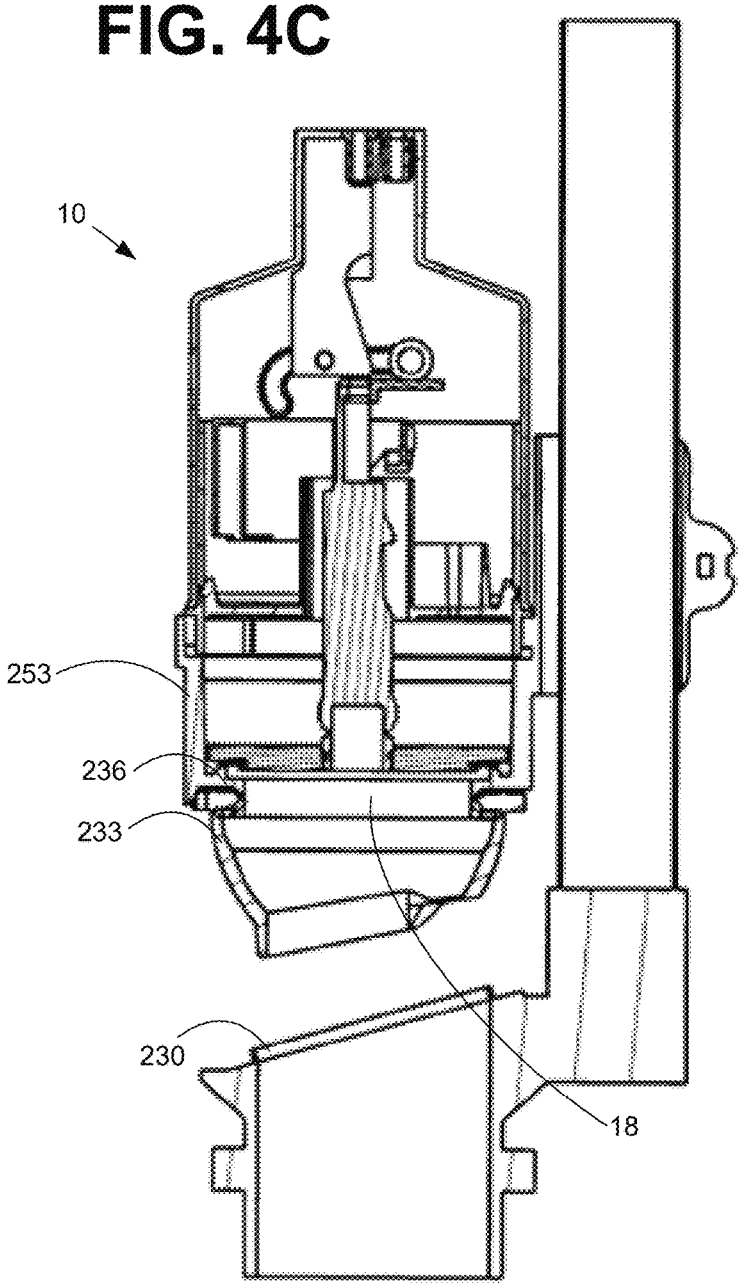
Figure 5:
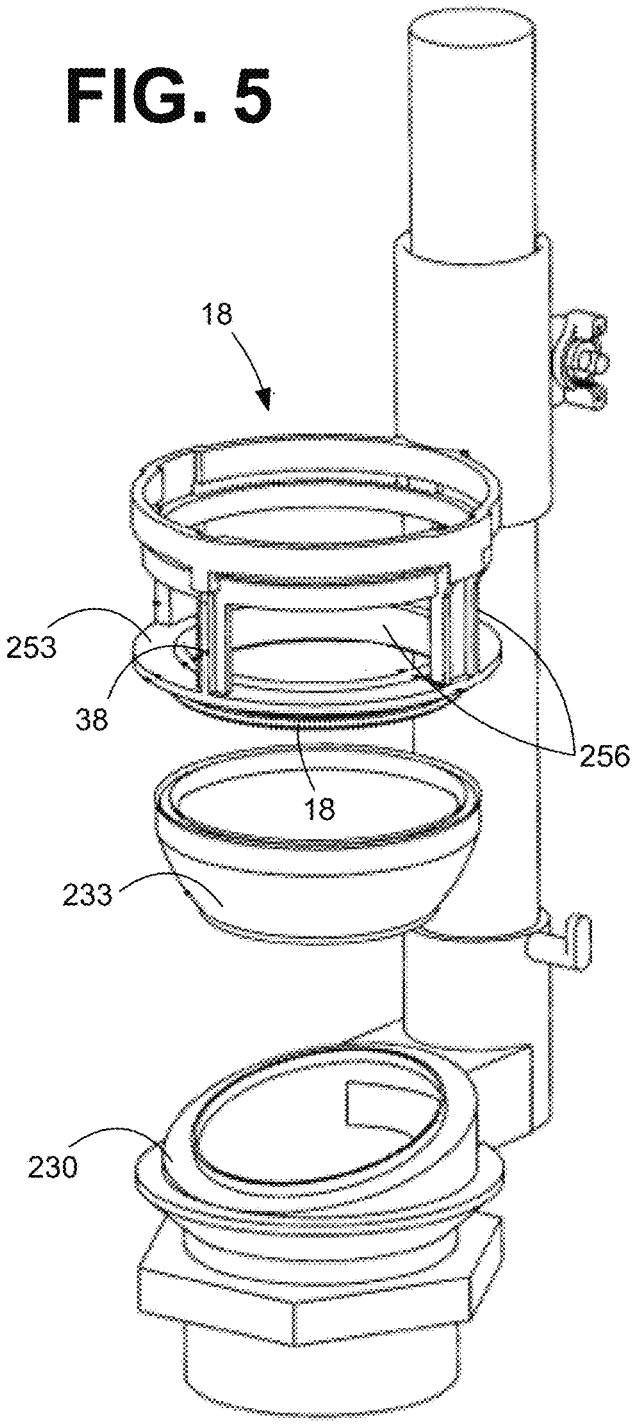
FIG. 5 is a drawing showing an example of a bottom portion of a toilet flush valve assembly of FIGS. 1A-1D, 2A-2D according to various embodiments of the present disclosure.

FIGS. 4B and 4C show an example of the toilet flush valve assembly 10 mounted to a previously existing flush valve 230 via a gasket 233 that is attached to the toilet flush valve assembly 10 at slots 236 near the outlet opening 18. In particular, FIG. 4B shows the toilet flush valve assembly 10 installed, and FIG. 4C shows a partially-exploded view of the toilet flush valve assembly 10 and the flush valve 230. FIG. 5 shows an example of a bottom portion 253 of the toilet flush valve assembly 10 (FIGS. 4B-4C) and illustrates the legs 38 and water ports 256 that may facilitate water flowing through the opening 18 and into the toilet bowl (not shown).

Other types of toilet flush valve assemblies 10 and other components may be used in accordance with the present disclosure. For instance, U.S. patent application Ser. No. 13/539,960, filed on Jul. 2, 2012 and entitled "TOILET FLUSH VALVE WITH BOWL OVERFLOW PREVENTION," provides additional examples of toilet flush valve assemblies 10. This application is incorporated by reference herein in its entirety. Additionally, examples of mounting the toilet flush valve assemblies 10 to the toilet tank, the arrangement of a stand pipe, a tank flush valve and a float assembly and other items are not specifically discussed herein may be described further in U.S. patent application Ser. No. 12/715,757, filed on Mar. 2, 2011 and entitled "ADAPTATION OF FLUSH VALVE FOR DUAL FLUSH CAPABILITY." This application is incorporated by reference herein in its entirety.

FIGS. 6A-6C, 7A-7C, and 8A-8C show one embodiment, among others, of a flush handle assembly 101 that may mount, for example, to the front wall of a tank (not shown) of a toilet (not shown). The flush handle assembly 101 may be used for actuating the previously described toilet flush valve assemblies 10 (FIGS. 1A-1D, 2A-2D, 3A-3D) or other toilet flush valve assemblies 10 using the actuator cable 56 or other mechanism.

Figure 6A:
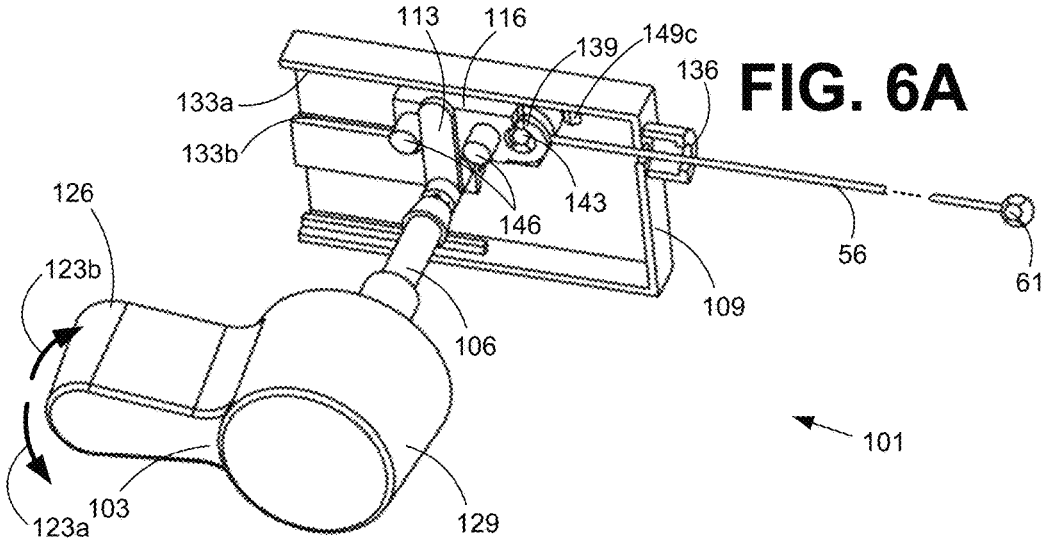
FIGS. 6A-6C are drawings of an example of a flush lever assembly in a neutral position according to various embodiments of the present disclosure.
Figure 6B:
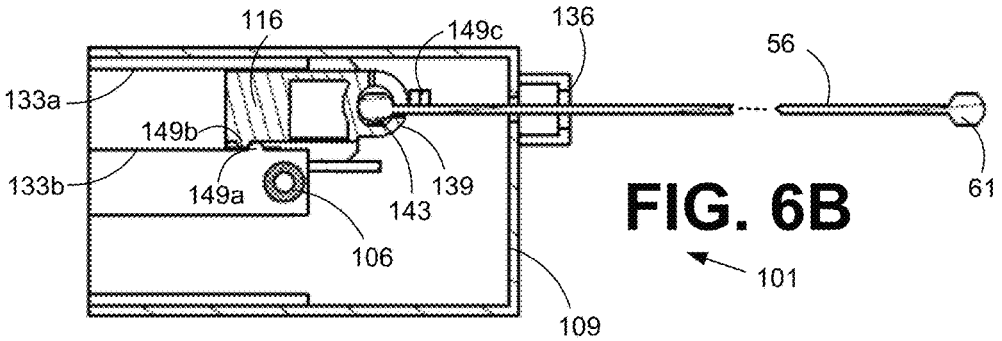
Figure 6C:
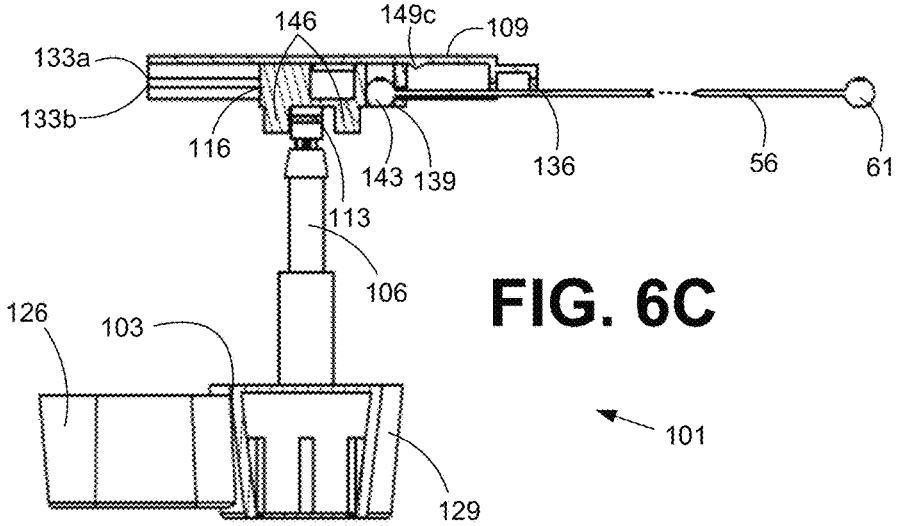

With reference to FIGS. 6A-6C, shown is one embodiment, among others, of a flush handle assembly 101 in a neutral position. The flush handle assembly 101 may arrive in the neutral position, for example, after a flush has been initiated or after a flush has been returned from an interrupt position. The flush handle assembly 101 may include a toilet flush handle 103, a shaft 106, a housing assembly 107, and actuator cable 56, and possibly other components. The housing assembly 107 may further include a housing 109, a cam 113, a slide 116, and possibly other components.

The toilet flush handle 103 may be a portion of the flush handle assembly 101 that a user can manipulate to initiate a flush and/or interrupt a flush that has been initiated. To this end, the toilet flush handle 103 may be configured to rotate about an axis defined by the shaft 106 in a first direction indicated generally by arrow 123*a* and in a second direction indicated generally by arrow 123*b*. The toilet flush handle 103 may include a distal end 126 and a proximal end 129. The distal end 126 may be the end of the toilet flush handle 103 that is farthest from the shaft 106, and the proximal end 129 may be the end of the toilet flush handle 103 that is closest to the shaft 106. When the flush handle assembly 101 is installed on a toilet, the toilet flush handle 103 is located external to the toilet tank.

The shaft 106 may be a rod or other type of component that connects the toilet flush handle 103 to the cam 113. When installed, the shaft 106 may pass through a toilet tank wall. According to various embodiments, the shaft 106 may be formed as a part of the toilet flush handle 103 and/or the cam 113. In some alternative embodiments, the shaft 106 may be a component that is separate from the toilet flush handle 103 and/or the cam 113.

The housing assembly 107 may be a portion of the flush handle assembly 101 that contains various components within the housing 109. For instance, the housing assembly 107 may contain at least portions of the shaft 106, the cam 113, the slide 116, the actuator cable 56, or potentially other components. The housing 109 may further include one or more rails 133*a*-133*b* that may receive and guide the slide 116. Also, the housing 109 may include an opening 136 through which the actuator cable 56 may extend and retract. In the views shown, a portion of the housing 109 has been removed to show the components and their relationships therein. In some embodiments, the housing assembly 107 may enclose all or part of the components it contains. When the flush handle assembly 101 is installed on a toilet, the housing 109 may be located inside of the toilet tank.

The slide 116 may connect to the actuator cable 56 and slide along the rails 133*a*-133*b*. As such, the slide 116 may include a connector 139 that receives and retains an enlarged end 143 or other portion of the actuator cable 56. Other mechanisms of connecting the slide 116 to the actuator cable 56 may be used as well. The slide 116 may also include one or more extensions 146 to facilitate the movement of the slide 116. For example, the cam 113 may be positioned adjacent to one or more of the extensions 146, and rotation of the cam 113 may push or pull one or more of the extensions 146 to thereby move the slide 116 along the rails 133*a*-133*b*.

The toilet flush handle 103 and a toilet flush valve assembly 10 (FIGS. 1A-1D, 2A-2, 3A-3D) may be in communication via the actuator cable 56. As such, the actuator cable 56 may be connected to the slide 116, pass through the opening 136 of the housing 109, and may be connected to the lever 36 (FIG. 1A), the wishbone-shaped actuator 83 (FIG. 2A), the finger 89 (FIG. 3A), or other component that may control the water flow. In some embodiments, a sheath (not shown) may cover at least a portion of the actuator cable 56.

The housing 109, the slide 116, and/or any other component may further include one or more restrictions 149*a*-149*c* that may restrict the toilet flush handle 103 from rotating or that may retain the toilet flush handle 103 in a particular position. For instance, the restrictions 149*a*-149*b* may prevent the toilet flush handle 103 from rotating in the direction indicated generally by arrow 123*b*, as will be discussed later. Further, the restriction 149*c*, for example, may retain the toilet flush handle 103 in an interrupt position.

As previously described, the spring 46 (FIGS. 1A-1D, 2A-2D, 3A-3D) of the toilet flush valve assembly 10 (FIGS. 1A-1D, 2A-2D, 3A-3D) may provide a bias force. This force may be transferred to the lever 36 (FIGS. 1A-1D), wishbone-shaped actuator 83 (FIGS. 2A-2D), or finger 89 (FIGS. 3A-3D), which in turn may pull the flush actuator cable 56 in a downward direction. The force applied to the flush actuator cable 56 in turn may be applied to the slide 116. Thus, the neutral position of the slide 116 and the toilet flush handle 103 may be that shown in FIGS. 6A-6C. As shown, the slide 116 may abut the restriction 149*c*, and the restriction 149*b* may abut the restriction 149*a*. Also, in the neutral position, the distal end 126 and the proximal end 129 of the toilet flush handle 103 may be substantially horizontal in some embodiments.

Figure 7A:
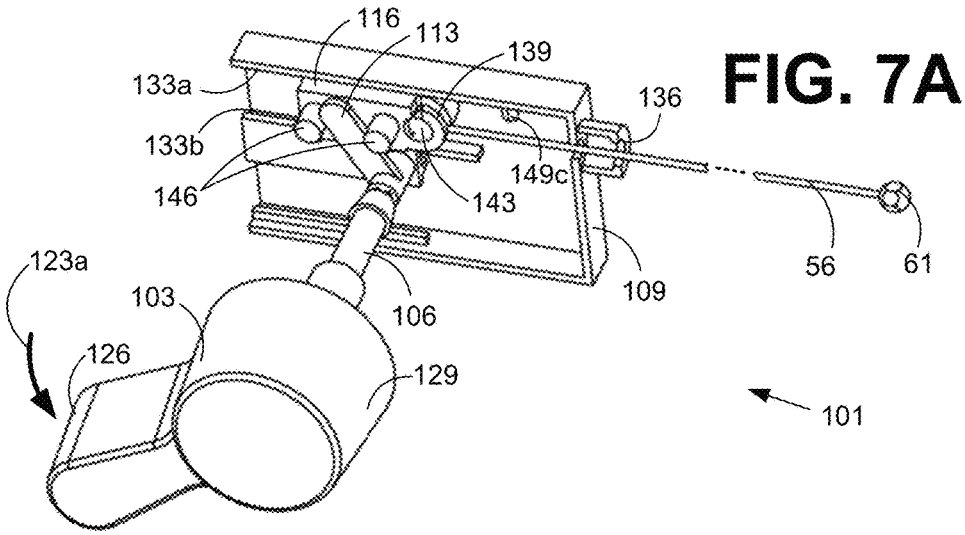
FIGS. 7A-7C are drawings of an example of a flush lever assembly in a position that initiates a toilet flush according to various embodiments of the present disclosure.
Figure 7B:
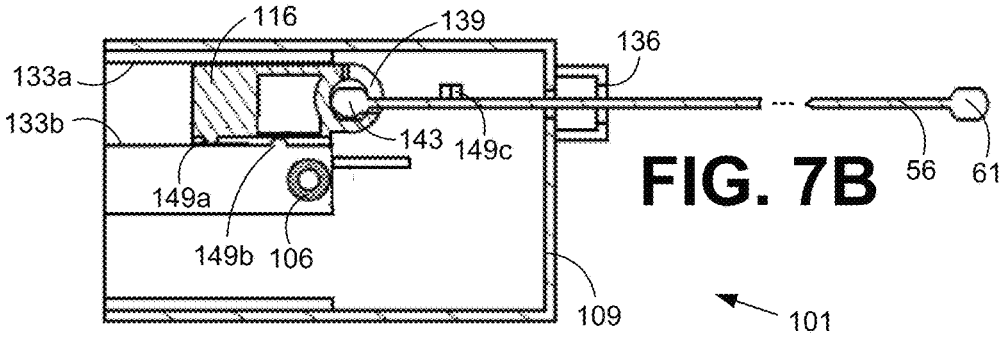
Figure 7C:
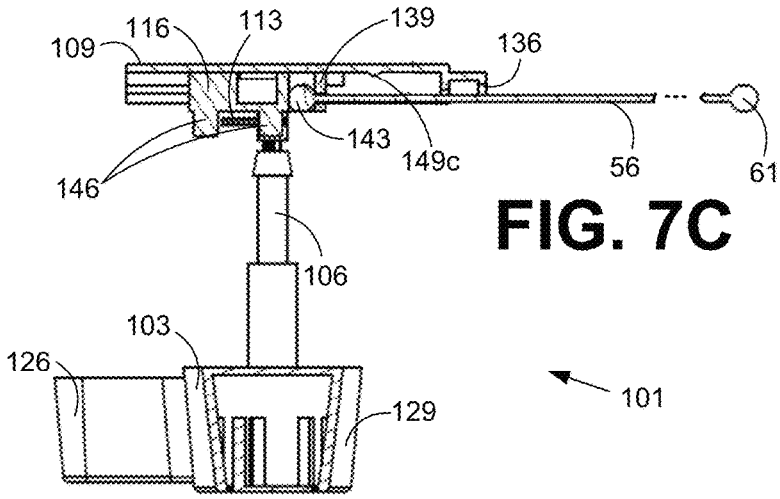

Turning now to FIGS. 7A-7C, shown is the flush handle assembly 101 in a position to initiate a toilet flush according to various embodiments of the present disclosure. The flush handle assembly 101 may arrive in the position, for example, in response to a user applying a force to the toilet flush handle 103 in the direction generally indicated by arrow 123*a*. As a result, the distal end 126 of the toilet flush handle 103 may be lower than the proximal end 129 of the flush handle 103 in some embodiments.

By the toilet flush handle 103 rotating in the direction indicated generally by the arrow 123*a*, the shaft 106 may also rotate. Because the shaft 106 is also connected to the cam 113, the cam 113 may rotate as well. As shown, this rotation of the cam 113 may move the slide 116 to cause the flush actuator cable 56 to retract into the housing 109. This movement of the actuator cable 56 may pull the lever 36 (FIG. 1A), the wishbone-shaped actuator 83 (FIG. 2A), the finger 89 (FIG. 3A), or other component that may initiate a toilet flush. As such, the toilet flush may be initiated by rotating the toilet flush handle 103 in a first direction to thereby open the toilet flush valve assembly 10 (FIGS. 1A-1D, 2A-2D, 3A-3D).

After the toilet flush has been initiated and the force that rotated the toilet flush handle 103 is withdrawn, the bias force from the spring 46 may cause, for example, the wishbone-shaped actuator 83, the finger 80, or another component, to return to its previous position. As a result, the actuator cable 56 and thus the slide 110 and the toilet flush lever 103 may return to the neutral position. In this position, the slide 116 may abut the restriction 149*c* and the restriction 149*a* may be in contact with the restriction 149*b*.

Figure 8A:
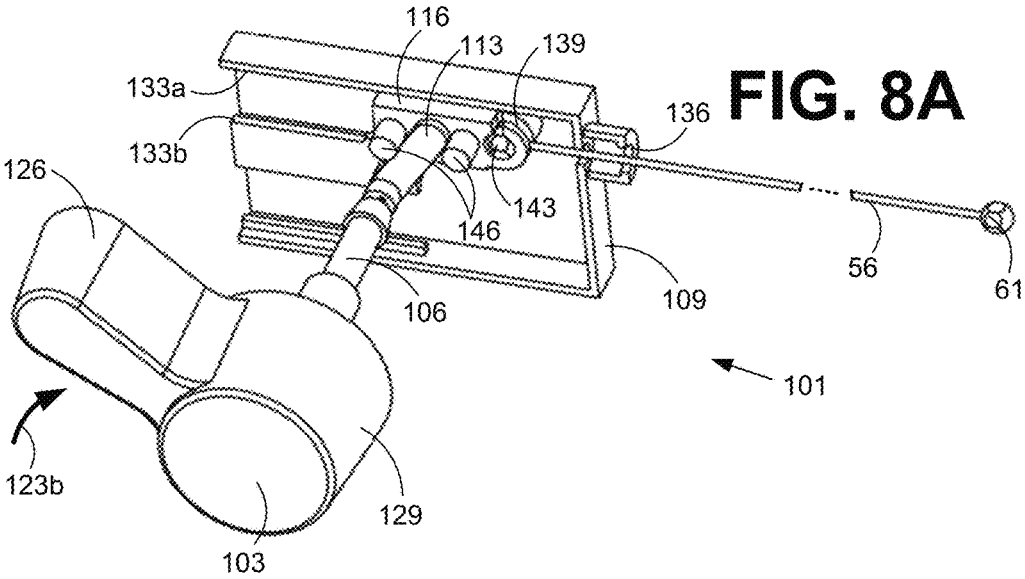
FIGS. 8A-8C are drawings of an example of a flush lever assembly in a position that interrupts a toilet flush according to various embodiments of the present disclosure.
Figure 8B:
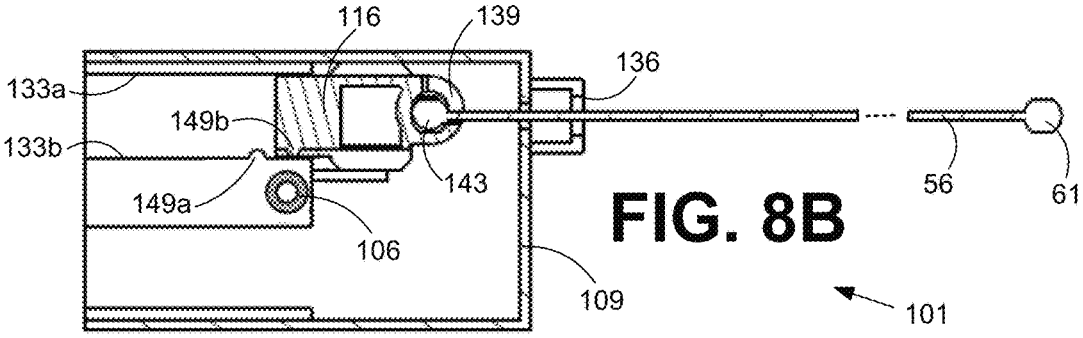
Figure 8C:
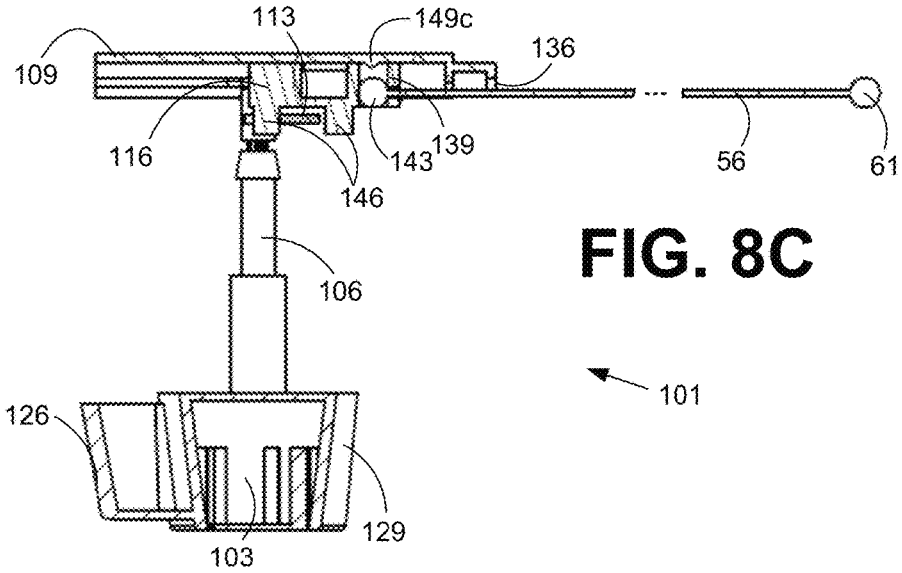

Turning now to FIGS. 8A-8C, shown is the flush handle assembly 101 in a position that may interrupt the water flow for a toilet flush. In this sense, the position shown in FIGS. 8A-8C may be regarded as being an emergency stop position. The flush handle assembly 101 may arrive in this interrupt position, for example, in response to a user applying a force to the toilet flush handle 103 in the direction generally indicated by arrow 123*b*. As a result, the distal end 126 of the toilet flush handle 103 may be higher than the proximal end 129 of the flush handle 103.

By the toilet flush handle 103 rotating in the direction indicated generally by the arrow 123*b*, the shaft 106 may also rotate. Because the shaft 106 is also connected to the cam 113, the cam 113 may rotate as well. As shown, this rotation of the cam 113 moves the slide 116 to cause the flush actuator cable 56 to extend out of the housing 109. This movement of the actuator cable 56 may push the lever 36 (FIG. 1A), the wishbone-shaped actuator 83 (FIG. 2A), the finger 89 (FIG. 3A), or other component that may interrupt a toilet flush.

Additionally, it may be desirable to prevent a toilet flush from being unintentionally interrupted. As such, the housing 109 may include the restriction 149*a*, and the slide 116 may include the restriction 149*b* to prevent the toilet flush handle 103 from rotating to the interrupt position. In order to engage the toilet flush handle 103 in the interrupt position shown in FIGS. 8A-8C from the neutral position shown in FIGS. 6A-6C, a user may provide a force in the direction indicated generally by the arrow 123*b* in an amount that is sufficient to overcome the resistance provided by the restrictions 149*a*-149*c* abutting each other or another component.

Once a toilet flush has been interrupted, it may be desirable to maintain the interrupted state, for example, so that a user can clear a clog that is the source of the overflow hazard. As such, the housing 109 may include the restriction 149*c* for retaining the toilet flush handle 103 in the interrupt position shown in FIGS. 8A-8C. In order to place the toilet flush handle 103 in this position, a user may provide a force in the direction indicated generally by the arrow 123*b* at an amount that is sufficient to overcome the resistance provided by the restriction 149*c* making contact with the connector 139 for the slide 116. Once the connector 139 for the slide 116 has overcome the restriction 149*c*, the slide 116 may be positioned so that the restriction 149*c* is located in a region defined by the connector 139, as best shown in FIG. 8C. Thus, the toilet flush handle 103 may be retained in the interrupt position in which the water flow for the toilet flush is interrupted.

Upon the overflow hazard being resolved, it may be desirable for the toilet flush handle 103 to return to the neutral position as shown in FIGS. 6A-6C. To this end, a user may rotate the toilet flush handle 103 in a direction opposite of that indicated generally by the arrow 123*b* with a force that is sufficient to overcome the resistance provided by the restriction 149*c* making contact with the connector 139 of the slide 116. Upon the restriction 149*a* making contact with the restriction 149*b*, the user may continue to rotate the toilet flush handle 103 in the direction indicated generally by the arrow 123*b* with a force sufficient to overcome the resistance provided by the restriction 149*a* making contact with the restriction 149*b*. After this maneuver, the flush handle assembly 101 may return to the neutral position shown in FIGS. 6A-6C.

Although preferred embodiments of the invention have been disclosed herein, it will be obvious to those skilled in the art that variations and modifications of the disclosed embodiments can be made without departing from the spirit and scope of the invention.

Therefore, the following is claimed:

1. A system, comprising:

a toilet flush handle assembly comprising a first housing;

a toilet flush valve assembly comprising a second housing affixed to an outlet opening;

an actuator cable that passes through each of the first housing and the second housing; and a toilet flush handle that controls the toilet flush valve assembly via the actuator cable, wherein the toilet flush handle rotates in a first direction to retract the actuator cable into the first housing and out of the second housing, causing a component within the second housing to rotate and thereby initiate a toilet flush in a toilet bowl by unsealing the outlet opening, and wherein the toilet flush handle further rotates in a second direction to extend the actuator cable out of the first housing and into the second housing, causing the component to rotate in another direction and thereby interrupt a water flow for the toilet flush by sealing the outlet opening.

2. The system of claim 1, wherein the first housing is attached to an inner wall of a toilet tank, and wherein the first housing receives a shaft that extends from the toilet flush handle.

3. The system of claim 2, further comprising:

a slide that is connected to the actuator cable; and a cam that is connected to the shaft that extends from the toilet flush handle, wherein the cam moves the slide to retract the actuator cable into the first housing when the toilet flush handle rotates in the first direction, and wherein the cam further moves the slide to extend the actuator cable out of the first housing when the toilet flush handle rotates in the second direction.

4. The system of claim 3, wherein the first housing further comprises a restriction that restricts the toilet flush handle from rotating in the second direction.

5. The system of claim 3, wherein the slide further comprises a restriction that restricts the toilet flush handle from rotating in the second direction.

6. The system of claim 3, further comprising means for retaining the toilet flush handle at an interrupt position in which the water flow for the toilet flush is interrupted.

7. An apparatus, comprising:

a toilet flush valve assembly; and a toilet flush handle that controls the toilet flush valve assembly using an actuator cable, where the toilet flush handle:

rotates in a first direction to cause the actuator cable to rotate a component within a housing of the toilet flush valve assembly and thereby unseal an outlet opening affixed to the housing and initiate a water flow for a toilet flush; and rotates in a second direction to cause the actuator cable to rotate the component within the housing of the toilet flush valve assembly in another direction and thereby seal the outlet opening affixed to the housing and interrupt the water flow for the toilet flush.

8. The apparatus of claim 7, wherein the toilet flush handle further:

rests in a neutral position;

initiates the toilet flush by rotating in the first direction from the neutral position; and interrupts the water flow for the toilet flush by rotating in the second direction from the neutral position.

9. The apparatus of claim 7, wherein the toilet flush handle automatically returns to a neutral position after initiating the toilet flush.

10. The apparatus of claim 7, wherein the toilet flush handle is retained in an interrupt position after being rotated in the second direction to interrupt the water flow for the toilet flush.

11. The apparatus of claim 7, wherein the first direction is a rotation that is opposite to the second direction.

12. A method, comprising:

rotating a toilet flush handle in a first direction to pull an actuator cable, causing a rotation of a component within a housing of a toilet flush valve assembly and thereby initiate a toilet flush by unsealing an outlet opening of the housing; and rotating the toilet flush handle in a second direction to push the actuator cable, causing another rotation of the component in another direction within housing of the toilet flush valve assembly and thereby interrupt the toilet flush by sealing the outlet opening of the housing.

13. The method of claim 12, wherein:

rotating the toilet flush handle in the first direction further comprises moving a distal end of the toilet flush handle upward relative to a proximal end of the toilet flush handle; and rotating the toilet flush handle in the second direction further comprises moving the distal end of the toilet flush handle downward relative to the proximal end of the toilet flush handle.

14. The method of claim 12, wherein:

rotating the toilet flush handle in the first direction to pull the actuator cable further comprises rotating the toilet flush handle from a neutral position to a flush position; and rotating the toilet flush handle in the second direction to push the actuator cable further comprises rotating the toilet flush handle from the neutral position to an interrupt position.

15. The method of claim 12, further comprising automatically returning the toilet flush handle to a neutral position after rotating the toilet flush handle in the first direction to initiate the toilet flush.

16. The method of claim 12, further comprising retaining the toilet flush handle in an interrupt position after rotating the toilet flush handle in the second direction to interrupt the toilet flush.

17. The method of claim 16, further comprising:

applying a force to the toilet flush handle in the first direction that overcomes a resistance that retains the toilet flush handle in the interrupt position; and returning the toilet flush handle to a neutral position after applying the force that overcomes the resistance.

18. The method of claim 12, wherein:

rotating the toilet flush handle in the first direction to pull the actuator cable further comprises unsealing an opening in the toilet flush valve assembly via the actuator cable; and rotating the toilet flush handle in the second direction to push the actuator cable further comprises sealing the opening in the toilet flush valve assembly via the actuator cable.

19. The system of claim 1, further comprising a sheath that covers at least a portion of the actuator cable.

20. The apparatus of claim 7, wherein at least a portion of the actuator cable is covered by a sheath.

* * * * *